US008861176B2

(12) United States Patent
Masuzawa

(10) Patent No.: US 8,861,176 B2
(45) Date of Patent: Oct. 14, 2014

(54) IGNITION COIL DEVICE

(75) Inventor: Takashi Masuzawa, Anjo (JP)

(73) Assignee: Denso Corporation, Kariya (JP)

( * ) Notice: Subject to any disclaimer, the term of this patent is extended or adjusted under 35 U.S.C. 154(b) by 24 days.

(21) Appl. No.: 13/487,830

(22) Filed: Jun. 4, 2012

(65) Prior Publication Data

US 2012/0307413 A1 Dec. 6, 2012

(30) Foreign Application Priority Data

Jun. 6, 2011 (JP) ..... 2011-126374

(51) Int. Cl.

| | |
|---|---|
| ***F23Q 3/00*** | (2006.01) |
| ***H01F 38/12*** | (2006.01) |
| ***F02P 3/01*** | (2006.01) |
| ***F02P 3/045*** | (2006.01) |

(52) U.S. Cl.

CPC ..... *F02P 3/0453* (2013.01)
USPC ..... 361/263; 361/253

(58) Field of Classification Search

CPC ..... F02P 3/0453; F02P 3/01; H10F 38/12; F23Q 3/004
USPC ..... 361/263, 253
See application file for complete search history.

(56) References Cited

U.S. PATENT DOCUMENTS

| | | | | |
|---|---|---|---|---|
| 3,961,617 | A * | 6/1976 | Satake | 123/598 |
| 4,105,007 | A | 8/1978 | Mochimaru | |
| 5,603,307 | A | 2/1997 | Morita et al. | |
| 5,870,012 | A * | 2/1999 | Sakamaki et al. | 336/107 |
| 6,166,933 | A * | 12/2000 | Bowers | 363/56.05 |
| 7,692,505 | B2 * | 4/2010 | Hashimoto | 331/158 |

FOREIGN PATENT DOCUMENTS

| | | |
|---|---|---|
| JP | A-52-121146 | 10/1977 |
| JP | A-04-116268 | 4/1992 |
| JP | A-8-273950 | 10/1996 |
| JP | A-2003-243234 | 8/2003 |

OTHER PUBLICATIONS

Office Action issued in Japanese Application No. 2011-126374 dated Apr. 23, 2013 (with translation).

* cited by examiner

*Primary Examiner* — Zeev V Kitov
(74) *Attorney, Agent, or Firm* — Oliff PLC

(57) ABSTRACT

An ignition coil device includes a primary coil, a switching member, a secondary coil and a parallel circuit. The primary coil is to be connected to an external power source. The switching member switches an on state and an off state of electric power supply from the power source to the primary coil. The secondary coil generates a voltage that causes spark discharge at a spark plug as the electric power supply from the power source is switched from the on state to the off state by the switching member. The parallel circuit includes a series coil and a resistor. The series coil is connected in series with a conducting section that electrically connects the secondary coil to the spark plug. The resistor is connected to the conducting section in parallel with the series coil and having a fixed electric resistance value.

4 Claims, 4 Drawing Sheets

IGNITION COIL DEVICE

CROSS REFERENCE TO RELATED APPLICATION

This application is based on Japanese Patent Application No. 2011-126374 filed on Jun. 6, 2011, the disclosure of which is incorporated herein by reference.

TECHNICAL FIELD

The present disclosure relates to an ignition coil device for generating a voltage that causes spark discharge at a spark plug.

BACKGROUND

Conventionally, it has been known to connect an ignition coil device to a spark plug to boost a voltage applied from an external power source. For example, JP2003-243234A (hereinafter referred to as the patent document 1) and JP08-273950A (corresponding to U.S. Pat. No. 5,603,307 and hereinafter referred to as the patent document 2) describe examples of such an ignition coil device. The described ignition coil device has a primary coil connected to a power source, a power transistor that switches on and off of electric power supply from the power source to the primary coil, and a secondary coil that generates a voltage to cause spark discharge.

Further, the patent document 1 describes to connect a resistor for noise reduction in series with a conducting section that electrically connects the secondary coil to the spark plug. The patent document 2 describes to connect a buffer coil in series with a conducting section that electrically connects the secondary coil to the spark plug.

Specifically, in the ignition coil device of the patent document 1, when the electric power supply to the primary coil is switched from an off state to an on state by the power transistor, a high voltage to cause spark discharge is induced in the secondary coil. The voltage is outputted from the secondary coil to the spark plug to cause breakdown between electrodes of the spark plug, thereby to generate the spark discharge. In accordance with such an electric conduction between the electrodes, an electric current instantly flows through the conducting section and respective components of the ignition coil device connected to the conducting section. An instant change of the electric current caused by the spark discharge induces a conduction noise in a component of the ignition coil device. Further, a radiation noise induced by the conduction noise is radiated from the component of the ignition coil device.

The noise reduction resistor of the patent document 1 reduces the instant change of the electric current in the conducting section by electric resistance (impedance). The buffer coil of the patent document 2 reduces the instant change of the electric current in the conducting section by impedance of the inductance. In this way, the noise reduction resistor and the buffer coil are employed to reduce the conduction noise and the radiation noise generated from the component of the ignition coil device.

SUMMARY

In recent years, ignition energy supplied from an ignition coil device to a spark plug has been increased. In a structure where a noise reduction resistor is used as the patent document 1, an electric current flowing in a wiring that connects from a secondary coil to the spark plug increases, resulting in an increase in power loss due to the noise reduction resistor. Therefore, to reduce such unexpected power loss, it has been required to use a buffer coil as the patent document 2.

However, a parasitic capacitance is generated between electrodes of a spark plug. Therefore, in a structure where a buffer coil is used as the patent document 2, a resonance circuit is formed by the buffer coil and the spark plug. As such, an impedance of the buffer coil is very small with respect to an electric current in a specific frequency band where the inductance of the buffer coil and the parasitic capacitance of the spark plug resonate. Because of such a characteristic of the buffer coil, an instant change of an electric current caused by spark discharge of the spark plug will not be reduced at the specific frequency band. As a result, the conduction noise and the radiation noise will be generated from a component of the ignition coil device in accordance with the instant change of the electric current.

It is an object of the present disclosure to provide an ignition coil device capable of reducing a noise caused by spark discharge of a spark plug while reducing electric power consumption.

According to a first aspect of the present disclosure, an ignition coil device includes a primary coil, a switching member, a secondary coil and a parallel circuit. The primary coil is to be connected to an external power source. The switching member switches an on state and an off state of electric power supply from the power source to the primary coil. The secondary coil generates a voltage that causes spark discharge at a spark plug by boosting a voltage applied from the power source as the electric power supply from the power source to the primary coil is switched from the on state to the off state by the switching member. The parallel circuit includes a series coil and a resistor. The series coil is connected in series with a conducting section that electrically connects the secondary coil to the spark plug. The resistor has a fixed electric resistance value, and is connected to the conducting section in parallel with the series coil.

In such an ignition coil device, self-resonance occurs due to structures of the respective components. Therefore, an impedance of the series coil largely changes according to frequency of an electric current. On the other hand, an impedance of the resistor, that is, the electric resistance value of the resistor is a fixed value and is not substantially changed according to frequency of an electric current. An impedance of the parallel circuit in which the series coil and the resistor are connected in parallel with each other can be defined as a combined impedance of the series coil and the resistor. In general, the change of impedance of the parallel circuit according to the frequency is smaller than the change of impedance of the individual series coil.

Namely, in the parallel circuit, a resonance characteristic of the series coil is moderated. With this, resonance of the series coil with a parasitic capacitance of the spark plug connected through the conducting section is reduced. Therefore, the impedance of the parallel circuit is maintained at a sufficient level, even with respect to an electric current in a frequency band where the inductance of the series coil and the parasitic capacitance of the spark plug resonate.

Accordingly, an instant change of an electric current caused in the conducting section by the spark discharge of the spark plug can be alleviated by the parallel circuit irrespective of the frequency of the electric current. Therefore, an occurrence of conduction noise in the component such as the switching member due to the instant change of the electric current is reduced. Further, a radiation noise radiated from the component due to the conduction noise is reduced. In this way, in the structure of using the series coil, the noise caused by the spark discharge of the spark plug can be reduced while reducing power consumption of the resistor.

According to a second aspect of the present disclosure, an ignition coil device includes a primary coil, a switching member, a secondary coil and a magnetic coupling circuit. The primary coil is to be connected to an external power source. The switching member switches an on state and an off state of electric power supply from the power source to the primary coil. The secondary coil generates a voltage that causes spark discharge at a spark plug by boosting a voltage supplied from the power source as the electric power supply from the power source to the primary coil is switched from the on state to the off state by the switching member. The magnetic coupling circuit includes a series coil, a coupling coil and a resistor. The series coil is connected in series with a conducting section that electrically connects the secondary coil to the spark plug. The coupling coil is connected in series with an isolated section that has a loop shape and is electrically isolated from the conducting section, and is magnetically coupled to the series coil. The resistor has a fixed electric resistance value and is connected in series with the isolated section.

In the magnetic coupling circuit, the series coil and the coupling coil are magnetically coupled to each other, and the resistor, which is connected in series with the isolated section together with the coupling coil, can have a structure equivalent to the resistor connected in parallel with the series coil. Therefore, the change of an impedance of the magnetic coupling circuit with respect to an electric current flowing in the conducting section according to the electric current conducted thereto is smaller than the change of an impedance of the individual series coil.

Namely, a resonance characteristic of the series coil is moderated by the magnetic coupling circuit. With this, resonance of the series coil with a parasitic capacitance of the spark plug connected through the conducting section is reduced. Therefore, the impedance of the magnetic coupling circuit is maintained at a sufficient level, even with respect to an electric current in a frequency band where the inductance of the series coil and the parasitic capacitance of the spark plug resonate.

Accordingly, an instant change of an electric current caused in the conducting section by the spark discharge of the spark plug can be alleviated by the magnetic coupling circuit irrespective of the frequency of the electric current. Therefore, an occurrence of conduction noise in the component such as the switching member due to the instant change of the electric current is reduced. Further, a radiation noise radiated from the component due to the conduction noise is reduced. In this way, in the structure of using the series coil, the noise caused by the spark discharge of the spark plug can be reduced while reducing power consumption of the resistor.

In addition, since the coupling coil is magnetically connected to the series coil, connection between the resistor and the series coil using wirings is not necessary. That is, a parasitic capacitance between such wirings and the series coil can be avoided. Accordingly, the noise caused by the spark discharge can be reduced.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which.

DETAILED DESCRIPTION

Hereinafter, exemplary embodiments of the present disclosure will be described with reference to the drawings. Like parts are designated with like reference numbers throughout the exemplary embodiments, and descriptions thereof will not be repeated. In a description of a subsequent embodiment, when only a part of components is described, other parts of the components may be provided by the components described in a preceding embodiment.

First Embodiment

Figure 1:
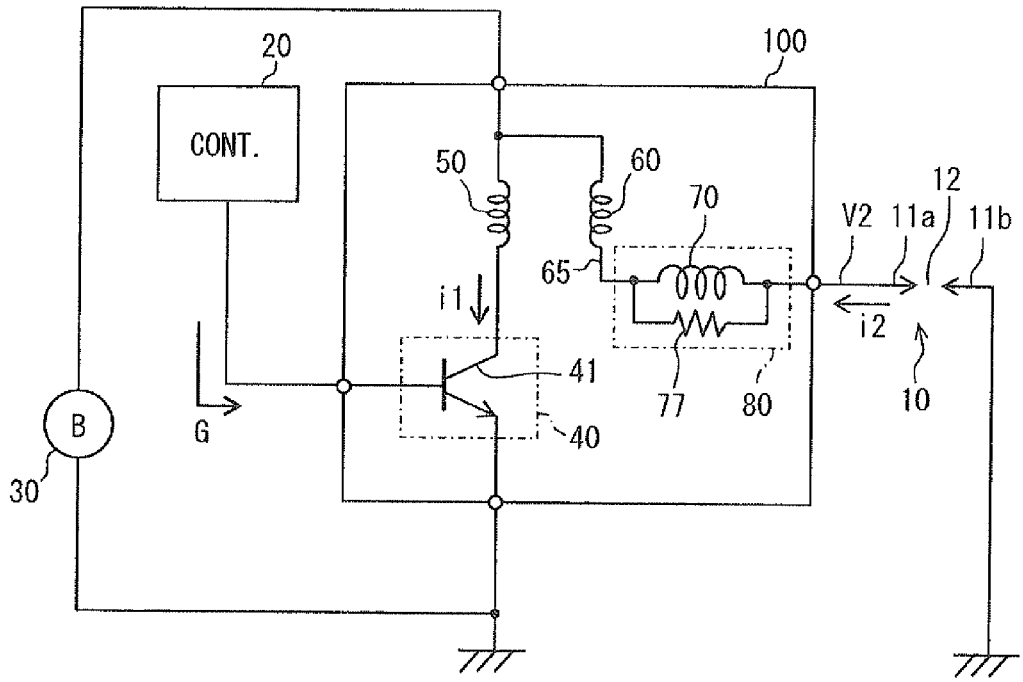
FIG. 1 is a diagram illustrating a circuit structure of an ignition coil device with a peripheral circuit structure according to a first embodiment of the present disclosure.

Referring to FIG. 1, an ignition coil device 100 according to the first embodiment is used in a spark ignition engine, such as a gasoline engine, and is connected to a spark plug 10. The ignition coil device 100 boosts a primary voltage applied from a power source 30, such as an alternator, in accordance with an ignition signal G outputted from a control unit 20 that controls a gasoline engine, thereby to generate a secondary voltage V2 for causing spark discharge at the spark plug 10. Hereinafter, the secondary voltage V2 is also referred to as a discharge voltage V2.

First, a structure of the spark plug 10 to which the ignition coil device 100 is connected will be described.

The spark plug 10 ignites an operation gas compressed in a combustion chamber of the gasoline engine by the spark discharge. The spark plug 10 has a pair of electrodes 11*a*, 11*b* made of a metal material. A gap 12 is provided between the electrode 11*a* and the electrode 11*b*. As the discharge voltage is applied between the electrode 11*a* and the electrode 11*b* by the ignition coil device 100, insulation at the gap 12 is broken down. With this, an electric current occurs between the electrode 11*a* and the electrode 11*b*, and thus the spark discharge occurs at the gap 12.

Next, a structure of the ignition coil device 100 will be described. The ignition coil device 100 includes a primary coil 50, a secondary coil 60, an igniter 40 and a conducting section (route) 65.

The primary coil 50 is formed by winding an enamel copper wire into a cylindrical shape around a cylindrical center core. The cylindrical center core is made of a soft magnetic material. The enamel copper wire is mainly made of a wire such as a copper wire. The primary coil 50 is electrically connected to the power source 30 disposed external to the ignition coil device 100 and the igniter 40. The primary coil 50 can conduct electric power supplied from the power source 30.

The secondary coil 60 is formed by winding an enamel copper wire into a cylindrical shape around a cylindrical bobbin. The bobbin is made of a resin material. The enamel copper wire is mainly made of a wire such as a copper wire. The primary coil 50 is disposed inside of the bobbin of the secondary coil 60. The secondary coil 60 is magnetically coupled to the primary coil 50 thereby to form a magnetic circuit of the ignition coil device 100 together with the primary coil 50, the center core and the like.

The line diameter of the enamel copper wire forming the secondary coil 60 is smaller than that of the enamel copper wire forming the primary coil 50. The number of turns of the enamel copper wire of the secondary coil 60 is greater than that of the enamel copper wire of the primary coil 50. The secondary coil 60 is electrically connected to the power source 30 and the conducting section 65.

The igniter 40 is connected to the control unit 20. The igniter 40 controls the electric power supply from the power source 30 to the primary coil 50 in accordance with the ignition signal G outputted from the control unit 20. The igniter 40 is provided by a circuit board that has a switching element 41 such as an insulated gate bipolar transistor (IGBT) and is molded with an insulative resin material.

An emitter of the IGBT 41 is connected to a wiring that is connected to an external ground, thereby to be grounded. A base of the IGBT 41 is connected to the control unit 20 to receive the ignition signal G from the control unit 20. A collector of the IGBT 41 is connected to the power source 30 through the primary coil 50.

The igniter 40 having the above described structure permits an electric current between the collector and the emitter as the ignition signal G indicating an on state is inputted into the base of the IGBT 41. As a result, a primary current i1 flows in the primary coil 50, which is connected between the power source 30 and the collector of the IGBT 41, due to the power source 30.

The conducting section 65 is connected between the secondary coil 60 and the spark plug 10 to electrically connect the secondary coil 60 to the spark plug 10. The discharge voltage V2 generated by the secondary coil 60 is applied to the spark plug 10 through the conducting section 65. For example, the conducting section 65 is provided by a terminal made of a conductive material, a coil spring and the like.

An operation of the ignition coil device 100 to generate the discharge voltage V2 will be described with reference to FIGS. 1 and 2.

Figure 2:
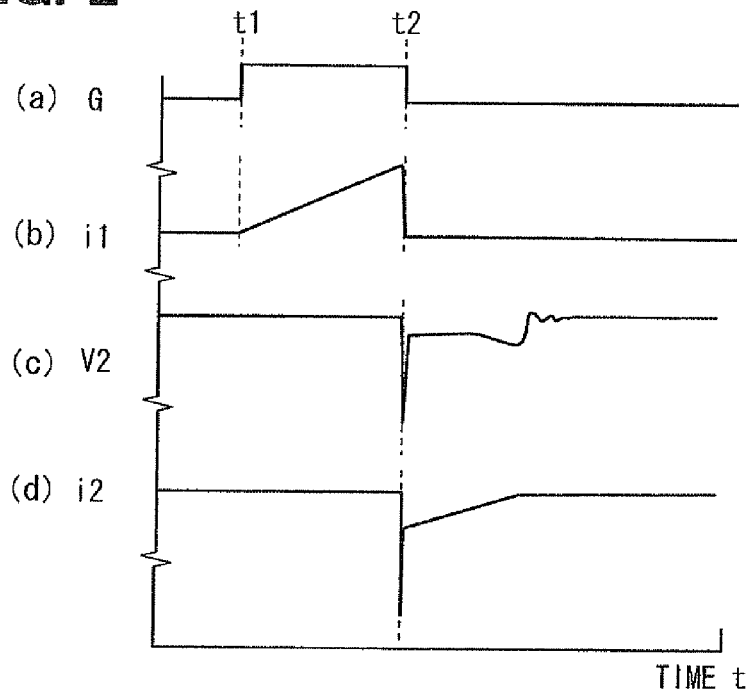
FIG. 2 is a diagram illustrating a time chart for explaining an operation of the ignition coil device according to the first embodiment, in which (a) illustrates a waveform of an ignition signal outputted from a control unit, (b) illustrates a waveform of a primary current flowing in a primary coil, (c) illustrates a waveform of a discharge voltage as a secondary voltage generated in a secondary coil, and (d) illustrates a waveform of a discharge current flowing from the secondary coil to the spark plug.

When the ignition signal G from the control unit 20 is switched from an off state to an on state at a timing t1 shown in (a) of FIG. 2, the conduction of the primary current i1 from the power source 30 to the primary coil 50 is switched from an off state to an on state as shown in (b) of FIG. 2. When the primary current i1 reaches a sufficient current value at a timing t2, the ignition signal G is switched from the on state to the off state as shown in (a) of FIG. 2. With this, the conduction of the primary current i1 from the power source 30 to the primary coil 50 is switched from the on state to the off state by the IGBT 41 as shown in (b) of FIG. 2. Thus, the primary current i1 flowing to the primary coil 50 is shut off, and magnetic energy accumulated in the magnetic circuit of the ignition coil device 100 while the primary current i1 is being supplied is induced in the secondary coil 60.

The magnetic energy induced in the secondary coil 60 by the above mutual inductive action is boosted from a voltage of the primary current i1 flowing in the primary coil 50 to for example approximately 30 to 50 kV in the secondary coil 60, which has a larger number of turns of the enamel copper wire than that of the primary coil 50. The boosted voltage is outputted from the secondary coil 60 to the spark plug 10 as the discharge voltage V2 for generating the spark discharge at the spark plug 10, as shown in (c) of FIG. 2.

When the discharge voltage V2 generated in the secondary coil 60 reaches a dielectric breakdown voltage of the gap 12 of the spark plug 10, electric discharge is begun at the gap 12 and the discharge current i2 begins to flow, as shown in (d) of FIG. 2. Specifically, a large capacitive discharge current instantly flows through the peripheral floating capacitive component around the gap 12, as indicated by a sharp drop of the electric current i2 at a timing t2 shown in (d) of FIG. 2. Successively, an inductive discharge current flows while being gradually reduced during a time period where the discharge voltage V2 is constant as shown in (c) of FIG. 2.

In this way, the ignition coil device 100 causes the spark discharge at the spark plug 10 at a predetermined ignition time.

In the above described ignition coil device 100, a noise is generated according to the electric conduction between the electrodes 11*a*, 11*b* of the spark plug 10. Further, the noise generated according to the above described capacitive discharge current is supplied to the conducting section 65, the respective components of the ignition coil device 100 connected to the conducting section 65, the control unit 20 and the like. The instant change of the electric current in accordance with the capacitive discharge current caused by the spark discharge results in a conduction noise in the respective components of the ignition coil device 100. Further, the conduction noise results in a radiation noise radiated from the respective components of the ignition coil device 100.

The ignition coil device 100 according to the first embodiment further has a noise reduction circuit 80 for reducing the above described conduction noise and radiation noise. Hereinafter, the noise reduction circuit 80 will be described in detail.

Figure 3:
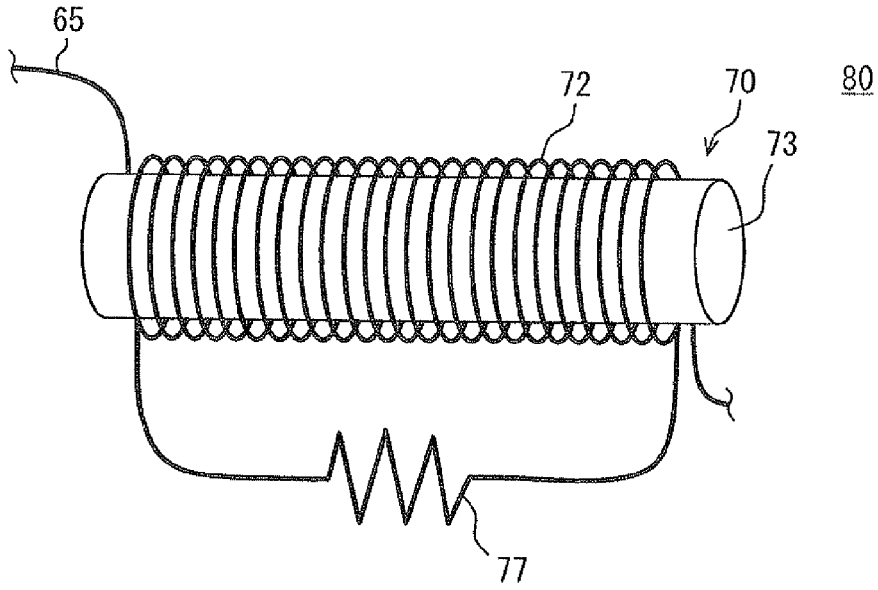
FIG. 3 is a diagram illustrating a schematic structure of a noise reduction circuit of the ignition coil device according to the first embodiment.
Figure 4:
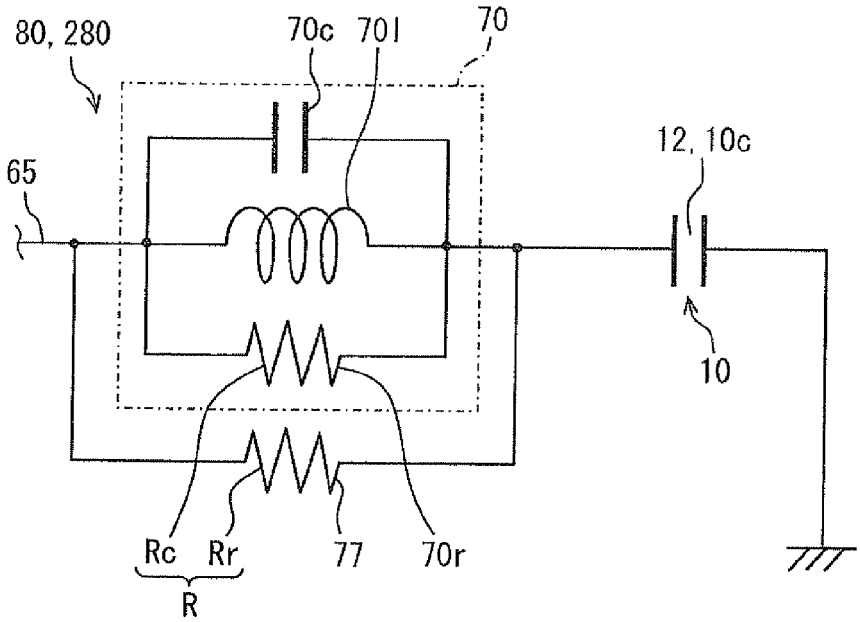
FIG. 4 is a diagram illustrating an equivalent circuit of a parallel resonance circuit provided by the noise reduction circuit and the spark plug according to the first embodiment.

As shown in FIGS. 1, 3 and 4, the noise reduction circuit 80 includes a buffer coil 70 and a resistor 77. The buffer coil 70 is connected in series with the conducting section 65. The buffer coil 70 is formed by winding a wire such as an enamel copper wire around a cylindrical or rod-shaped core 73 made of a magnetic material such as ferrite, as shown in FIG. 3.

The buffer coil 70 includes an internal resistive component 70*r* and a parasitic capacitive component 70*c* in addition to an inductance component 70*l* as a coil, as shown by an equivalent circuit of FIG. 4. In the first embodiment, the buffer coil 70 is configured to be equivalent to a structure where the inductance component 70*l*, the internal resistive component 70*r* and the parasitic capacitive component 70*c* are connected in parallel with each other. The internal resistive component 70*r* is caused by such as loss due to a hysteresis of the core 73.

The parasitic capacitive component 70*c* is caused by electricity charged between adjacent turns of the enamel copper wire 72.

The resistor 77 is connected to the conducting section 65 in parallel with the buffer coil 70, as shown in FIG. 1. For example, the resistor 77 is connected to the enamel copper wire 72 of the buffer coil 70 through wirings such as leads or the like, as shown in FIG. 3. The resistor 77 includes a predetermined fixed electric resistance value Rr, as shown an equivalent circuit of FIG. 4 in which the noise reduction circuit 80 is configured as a parallel resonance circuit.

The electric resistance value Rr of the resistor 77 does not substantially change in accordance with a frequency of an electric current applied thereto. The electric resistance value Rr of the resistor 77 is smaller than an equivalent parallel resistance value Rc of the internal resistive component 70*c*. The equivalent parallel resistance value Rc corresponds to a resistance value of the buffer coil 70 when the noise reduction circuit 80 is defined in the equivalent circuit as the parallel resonance circuit.

Figure 5A:
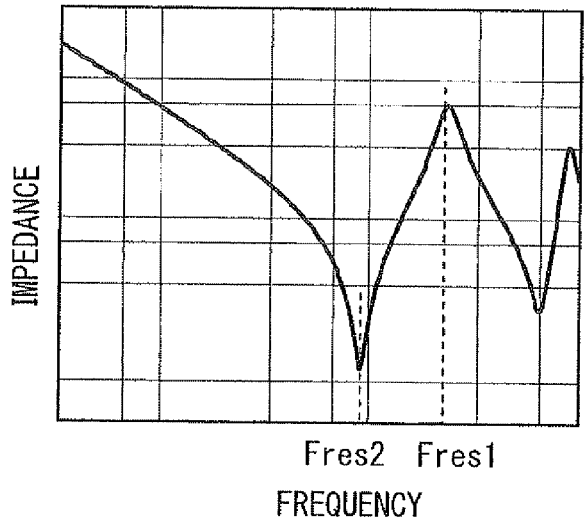
FIG. 5A is a diagram illustrating a graph indicating a correlation between a frequency of an electric current flowing in a buffer coil and an impedance according to the first embodiment.
Figure 5B:
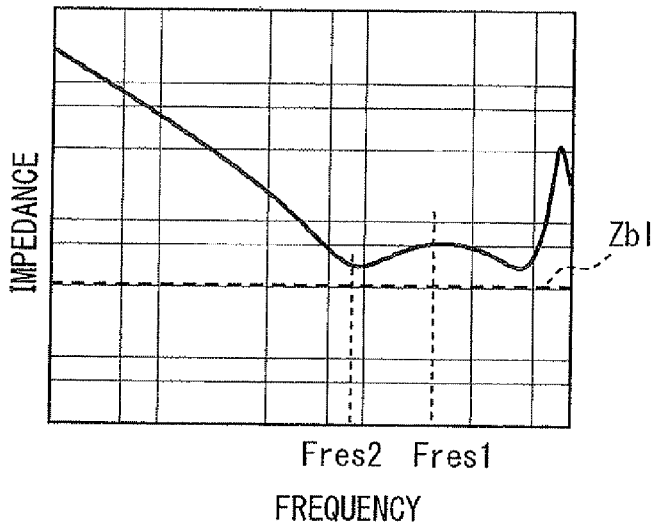
FIG. 5B is a diagram illustrating a graph indicating a correlation between a frequency of an electric current flowing in the noise reduction circuit and an impedance according to the first embodiment.

Next, a function of the resistor 77 of the noise reduction circuit 80 will be described with reference to FIG. 4 and FIGS. 5A and 5B, which indicate resonance characteristics. FIG. 5A is a diagram illustrating a correlation between a frequency of an electric current conducted to the buffer coil 70 and an impedance. FIG. 5B is a diagram illustrating a correlation between a frequency of an electric current conducted to the noise reduction circuit 80 and an impedance. Namely, FIGS. 5A and 5B are diagrams for explaining an effect provided by the resistor 77 of the noise reduction circuit 80. In FIGS. 5A and 5B, the horizontal axis represents the frequency of the electric current in common logarithm and the vertical axis represents the impedance in common logarithm.

As shown in FIGS. 4 and 5A, in the individual buffer coil 70 to which the resistor 77 is not connected, the inductance component 70*l* and the parasitic capacitive component 70*c*, which are connected in parallel with each other, cause parallel resonance at a resonance frequency Fres1 that is determined by the values of the inductance component 70*l* and the parasitic capacitive component 70*c*.

In such a parallel resonance state, the same amount of electric current flows in the inductance component 70*l* and the parasitic capacitive component 70*c* but in counter directions. As a result, the amount of electric current from the secondary coil 60 to the spark plug 10 through the inductance component 70*l* and the parasitic capacitive component 70*c* is very small.

Accordingly, only the electric current passing through the internal resistive component 70*r* substantially flows in the spark plug 10. In this way, the impedance of the buffer coil 70 is very large at the self-resonant frequency Fres1 where the inductance component 70*l* and the parasitic capacitive component 70*c* cause the parallel resonance (hereinafter, also referred to as self resonance).

Further, a parasitic capacitive component 10*c* is generated at the gap 12 of the spark plug 10. That is, a series resonance circuit is provided by the inductance component 70*l* of the buffer coil 70 and the parasitic capacitive component 10*c* of the spark plug 10. Therefore, the inductance component 70*l* and the parasitic capacitive component 10*c* cause series resonance at a resonance frequency Fres2 that is determined by the values of the inductance component 70*l* and the parasitic capacitive component 10*c*.

In such a series resonance state, the same amount of electric current flows in the inductance component 70*l* and the parasitic capacitive component 10*c* but in counter directions. As a result, a voltage drop at the buffer coil 70 and the spark plug 10 is very small.

Accordingly, the electric current supplied from the secondary coil 60 to the spark plug 10 easily passes through the inductance component 70*l*. In this way, the impedance of the buffer coil 70 is very small at the resonance frequency Fres2 where the inductance component 70*l* and the parasitic capacitive component 10*c* cause the series resonance.

In contrast to the resonance frequency of the individual buffer coil 70 described above, the resonance characteristic of the noise reduction circuit 80 having the resistor 77 is moderated as shown in FIG. 5B. Namely, as shown in FIGS. 4 and 5B, when the resistor 77 is connected in parallel with the buffer coil 70, a combined resistance value R of the noise reduction circuit 80 is smaller than the equivalent parallel resistance value Rc of the buffer coil 70.

Therefore, the electric current supplied from the secondary coil 60 to the spark plug 10 easily passes through the internal resistive component 70*r* and the resistor 77. As a result, even if the electric current supplied from the secondary coil 60 to the spark plug 10 is difficult to pass through the inductance component 70*l* and the parasitic capacitive component 70*c* at the band around the self-resonance frequency Fres1, the electric current can pass through the internal resistive component 70*r* and the resistor 77.

Accordingly, although the impedance of the noise reduction circuit 80 is very large at the self-resonance frequency Fres1, the impedance does not have the sharp increase as that of the individual buffer coil 70 shown in FIG. 5A.

Such a resonance characteristic is indicated by a value Q of the following expression (1):

$$Q=R/(2\pi f\cdot L) \quad (1)$$

in which f denotes a frequency of an electric current conducted to the circuit, and L denotes the value of the inductance component 70*l* of the buffer coil 70. As the value Q reduces, the resonance of the circuit reduces.

In the noise reduction circuit 80, the combined resistance value R, which is a right-hand side member in the expression (1), is reduced since the resistor 77 is connected in parallel with the buffer coil 70. Therefore, because the value Q is reduced by the addition of the resistor 77, the resonance characteristic of the noise reduction circuit 80 is moderated.

The noise reduction circuit 80, in which the resonance characteristic of the buffer coil 70 is moderated, hardly resonates with the parasitic capacitive component 10*c* of the spark plug 10 connected through the conducting section 65. Therefore, the impedance of the noise reduction circuit 80 is maintained at a value greater than a predetermined reference value Zbl shown by a dashed line in FIG. 5B, with respect to the electric current in the band around the resonance frequency Fres2 where the inductance component 70*l* of the buffer coil 70 and the parasitic capacitive component 10*c* of the spark plug 10 resonate.

According to the first embodiment described above, the instant change of the discharge current i2 generated in the conducting section 65 by the spark discharge of the spark plug 10 can be reduced by the noise reduction circuit irrespective of the frequency of the discharge current i2. Therefore, an occurrence of conduction noise in the respective components of the ignition coil device 100, such as the igniter 40 and the primary coil 50, due to the instant change of the discharge current i2 can be reduced. Further, a radiation noise radiated from the respective components due to the conduction noise can be reduced. In this way, in the ignition coil device 100 employing the buffer coil 70, the noise caused by the spark discharge of the spark plug 10 can be reduced while reducing power consumption by the resistor 77.

In addition, the electric resistance value Rr of the resistor 77 is smaller than the equivalent parallel resistance value Rc of the buffer coil 70. Therefore, in the noise reduction circuit 80, the electric current is more likely to flow in the resistor 77 than the internal resistive component 70*r*. Therefore, a reduction effect of the combined resistance value R of the noise reduction circuit 80 by the addition of the resistor 77 is ensured. It is less likely that the characteristic of the buffer coil 70 where the impedance varies will affect the characteristic of the impedance of the noise reduction circuit 80. As such, the resonance characteristic of the noise reduction circuit 80 is securely moderated.

Accordingly, in the noise reduction circuit 80, the series resonance with the parasitic capacitive component 10*c* of the spark plug 10 is further reduced. Therefore, with respect to the electric current in the band around the resonance frequency Fres2, the impedance of the noise reduction circuit 80 is more securely ensured. Since the effect of reducing the instant change of the electric current is provided by the above noise reduction circuit 80, the conduction noise and the radiation noise generated in the respective components of the ignition coil device 100 are further reduced.

In the first embodiment, the igniter 40 corresponds to a switching member, and the buffer coil 70 corresponds to a series coil. Also, the noise reduction circuit 80 corresponds to a parallel circuit.

Second Embodiment

Figure 6:
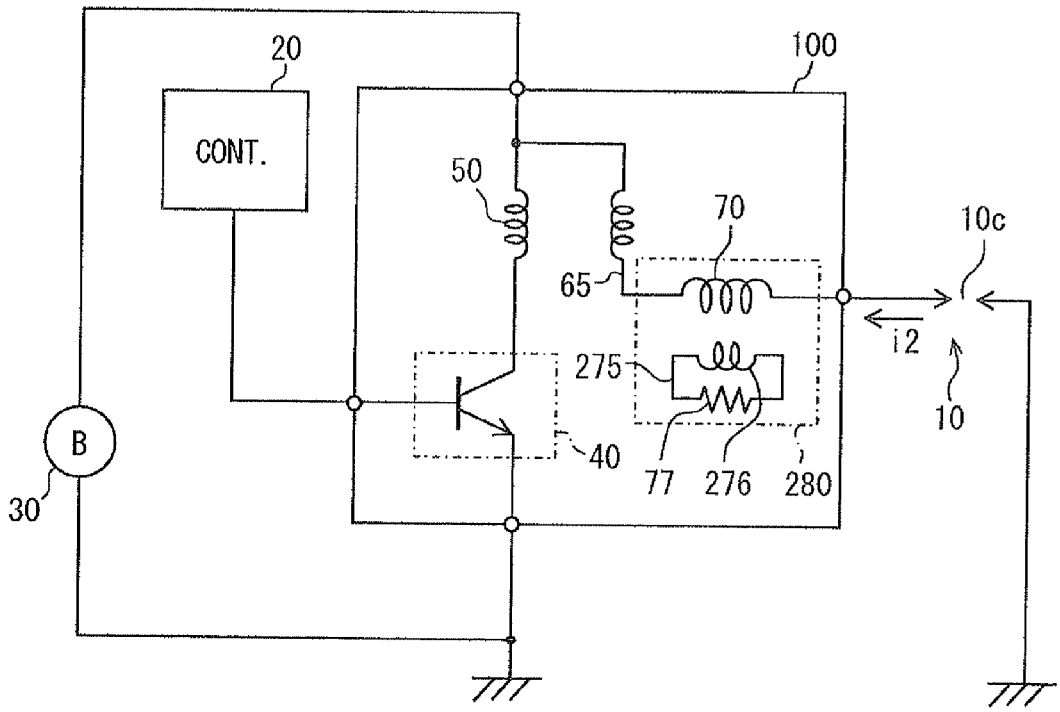
FIG. 6 is a diagram illustrating a circuit structure of an ignition coil device with a peripheral circuit structure according to a second embodiment of the present disclosure.
Figure 7:
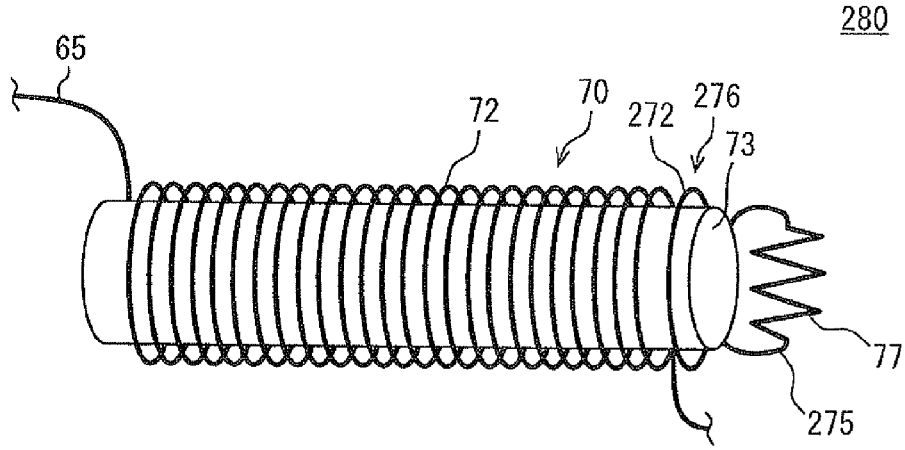
FIG. 7 is a diagram illustrating a schematic structure of a noise reduction circuit of the ignition coil device according to the second embodiment.

Referring to FIGS. 6 and 7, an ignition coil device 100 according to the second embodiment has a noise reduction circuit 280, which is modified from the noise reduction circuit 80 of the first embodiment.

The noise reduction circuit 280 includes a coupling coil 276, an isolated section 275, a buffer coil 70 and a resistor 77. The buffer coil 70 and the resistor 77 are substantially the same as those of the first embodiment.

The coupling coil 276 is connected in series with the isolated section 275. The coupling coil 276 is formed by winding an enamel copper wire 272 around the core 73. Both the coupling coil 276 and the buffer coil 70 are wound around the core 73, and are aligned to each other in an axial direction of the core 73. In this way, the coupling coil 276 is magnetically coupled to the buffer coil 70.

The isolated section 275 is electrically isolated from the conducting section 65. The isolated section 275 connects between one end of the coupling coil 276 and one end of the resistor 77, and connects between the other end of the coupling coil 276 and the other end of the resistor 77. Namely, the isolated section 275 forms a closed loop circuit with the coupling coil 276 and the resistor 77.

The buffer coil 70 is connected in series with the conducting section 65, in the similar manner to that of the first embodiment. The resistor 77 is connected in series with the isolated section 275, together with the coupling coil 276. For example, the resistor 77 is connected to an enamel copper wire 272 of the coupling coil 276 through wirings such as leads. The resistor 77 has the predetermined fixed electric resistance value Rr (see FIG. 4) and disturbs the electric current in the isolated section 275. The electric resistance value Rr of the resistor 77 does not substantially change in accordance with the frequency of the electric current conducted thereto. The electric resistance value Rr is smaller than the equivalent parallel resistance value Rc (see FIG. 4) of the buffer coil 70.

In the noise reduction circuit 280 having the above described structure, since the buffer coil 70 and the coupling coil 276 are magnetically coupled, the resistor 77 connected to the isolated section 275 can be equivalent to a resistor connected in parallel with the buffer coil 70. As such, the noise reduction circuit 280 can be regarded as a circuit structure equivalent to the circuit structure shown in FIG. 4. Therefore, the change of an impedance of the noise reduction circuit 280 with respect to the electric current flowing in the conducting section 65 in accordance with the frequency of the conducted electric current is smaller than the change of the impedance of the individual buffer coil 70, similar to the noise reduction circuit 80 of the first embodiment.

Because the resonance characteristic of the noise reduction circuit 280 is moderated in the above described manner, the noise reduction circuit 280 hardly resonates with the parasitic capacitive component 10*c* of the spark plug 10 connected through the conducting section 65. Therefore, the impedance of the noise reduction circuit 280 can be maintained at a value greater than the predetermined reference value Zb1 (see FIG. 5B) with respect to the electric current in the band around the resonance frequency Fres2 where the inductance component 70*l* and the parasitic capacitive component 10*c* resonate.

Also in the second embodiment shown in FIG. 6, the instant change of the discharge current i2 (see (d) of FIG. 2) generated in the conducting section 65 in accordance with the spark discharge is reduced by the noise reduction circuit 280 irrespective of the frequency of the discharge current i2. With this, an occurrence of conduction noise in the respective components of the ignition coil device 100 such as the igniter 40 and the primary coil 50 due to the instant change of the discharge current i2 can be reduced. Further, the radiation noise radiated from the respective components of the ignition coil device 100 due to the conduction noise can be reduced. Accordingly, in the structure employing the buffer coil 70, the noise caused by the spark discharge of the spark plug 10 can be reduced while reducing the power consumption by the resistor 77.

In the ignition coil device 100, which is required to reduce in size as a recent demand, it is generally difficult to arrange the resistor 77 and the buffer coil 70 next to each other. If the resistor 77 and the buffer coil 70 are arranged to be separated from each other, wirings connecting between the resistor 77 and the buffer coil 70 are disposed adjacent to the enamel copper wire 72 of the buffer coil 70, resulting in a parasitic capacitance. This parasitic capacitance causes unexpected resonance with the inductance component 70*l* of the buffer coil 70, and forms a bypass path without passing through the buffer coil 70. In such a case, therefore, the impedance of the noise reduction circuit 280 will be reduced at a specific frequency band.

In the second embodiment, on the other hand, the coupling coil 276 is magnetically coupled to the buffer coil 70. Therefore, direct connection between the resistor 77 and the buffer coil 70 through wirings can be omitted. Namely, the wirings for directly connecting between the resistor 77 and the buffer coil 70 are not required. Therefore, such parasitic capacitance between the wirings and the enamel copper wire 72 can be avoided. Although it is generally difficult to arrange the resistor 77 and the buffer coil 70 next to each other, since the ignition coil device 100 has the above described noise reduction circuit 280, the conduction noise and the radiation noise caused by the spark discharge can be reduced.

In the second embodiment, since the coupling coil 276 and the buffer coil 70 are aligned to each other in the axial direction of the core 73, it is less likely that the size of the ignition coil device 100 will be increased due to the addition of the coupling coil 276. The buffer coil 70 and the coupling coil 276 are aligned in the axial direction of the core 73 and wound around the same core 73. Therefore, the magnetic coupling between the buffer coil 70 and the coupling coil 276 improves. Further, the coupling coil 276 and the resistor 77 can be configured as a structure equivalent to the resistor that is connected in parallel with the buffer coil 70. Accordingly, the noise reduction circuit 280 can ensure the characteristic of impedance similar to that of the noise reduction circuit 80 of the first embodiment. Further, even in the ignition coil device 100 in which the arrangement flexibility of the resistor 77 is improved, the noise caused by the spark discharge of the spark plug 10 can be reduced.

In the second embodiment, the core 73 corresponds to a core part, and the noise reduction circuit 280 corresponds to a magnetic coupling circuit.

Other Embodiments

While only the selected exemplary embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiments according to the present disclosure is provided for illustration only, and not for the purpose of limiting the disclosure as defined by the appended claims and their equivalents. The followings are examples of modifications of the above described exemplary embodiments.

In the first and second embodiments, the electric resistance value Rr of the resistor 77 is smaller than the equivalent parallel resistance value Rc of the buffer coil 70. Alternatively, the internal resistance value of the resistor 77 may be suitably changed in accordance with the equivalent parallel resistance value of the buffer coil 70, the reference value of the impedance required in the noise reduction circuit 80, 280, and the like.

Also, the value of the inductance of the buffer coil 70 may be suitably changed by adjusting the number of turns and the line diameter of the enamel copper wire in accordance with the degree of the parasitic capacitance generated in the spark plug 10, the reference value of the impedance required in the noise reduction circuit 80, 280, and the like. Further, the ratio of the value of inductance of the buffer coil 70 and the electric resistance value of the resistor 77 may be suitably changed so that the noise can be efficiently reduced.

In the second embodiment, the buffer coil 70 and the coupling coil 276 are wound around the same core 73 and are aligned to each other in the axial direction of the core 73. However, the relative position of the buffer coil 70 and the coupling coil 276 may be suitably changed as long as the magnetic coupling between the buffer coil 70 and the coupling coil 276 is securely ensured. For example, the buffer coil 70 and the coupling coil 276 may be wound around difference cores. For example, the coupling coil 276 may be located on an outer periphery of the buffer coil 70 so that the coupling coil 276 is arranged in parallel with the buffer coil 70. In the first and second embodiments, the core 73 may be eliminated.

In the second embodiment, the number of turns and/or the line diameter of the enamel copper wire 272 of the coupling coil 276 may be suitably changed. For example, the number of turns of the coupling coil 276 may be smaller than that of the buffer coil 70. As another example, the number of turns of the coupling coil 276 may be greater than that of the buffer coil 70. For example, the line diameter of the enamel copper wire 272 of the coupling coil 276 may be smaller than that of the enamel copper wire 72 of the buffer coil 70. As another example, the line diameter of the enamel copper wire 272 of the coupling coil 276 may be greater than that of the enamel copper wire 72 of the buffer coil 70. As further another example, at least one of the number of turns of the enamel copper wire and the line diameter of the enamel copper wire may be the same between the coupling coil 276 and the buffer coil 70.

What is claimed is:

1. An ignition coil device to be connected to a spark plug and for generating a voltage that causes spark discharge at the spark plug by boosting a voltage applied from an external power source, the ignition coil device comprising:

a primary coil to be connected to the power source;

a switching member switching an on state and an off state of electric power supply from the power source to the primary coil;

a secondary coil generating the voltage that causes the spark discharge as the electric power supply from the power source to the primary coil is switched from the on state to the off state by the switching member; and a parallel circuit including a series coil and a resistor, the series coil being connected in series with a conducting section that electrically connects the secondary coil to the spark plug, the resistor having a fixed electric resistance value and being connected to the conducting section in parallel with the series coil, wherein the series coil includes an internal resistive component, a parasitic component, and an inductance component, which are connected in parallel with one another, and the fixed electric resistance value of the resistor is smaller than a resistance value of the internal resistive component.

2. An ignition coil device to be connected to a spark plug and for generating a voltage that causes spark discharge at the spark plug by boosting a voltage applied from an external power source, the ignition coil device comprising:

a primary coil to be connected to the power source;

a switching member switching an on state and an off state of electric power supply from the power source to the primary coil;

a secondary coil generating the voltage that causes the spark discharge as the electric power supply from the power source to the primary coil is switched from the on state to the off state by the switching member; and a magnetic coupling circuit including (1) a series coil connected with a conducting section that electrically connects the secondary coil to the spark plug and (2) an isolated section, the isolated section comprising a coupling coil and a resistor connected in series in a closed loop, and the isolated section being electrically isolated from the conducting section, and the coupling coil being magnetically coupled to the series coil, wherein the resistor has a fixed electric resistance value, wherein the series coil includes an internal resistive component, a parasitic component, and an inductance component, which are connected in parallel with one another, and the fixed electric resistance value of the resistor is smaller than a resistance value of the internal resistive component.

3. The ignition coil device according to claim 2, wherein the magnetic coupling circuit further includes a core that is made of a magnetic material and has a rod shape, and the series coil and the coupling coil are wound around the core and aligned to each other in an axial direction of the core.

4. An ignition coil device to be connected to a spark plug and for generating a voltage that causes spark discharge at the spark plug by boosting a voltage applied from an external power source, the ignition coil device comprising:

a primary coil to be connected to the power source;

a switching member switching an on state and an off state of electric power supply from the power source to the primary coil;

a secondary coil generating the voltage that causes the spark discharge as the electric power supply from the power source to the primary coil is switched from the on state to the off state by the switching member; and a parallel circuit consisting essentially of a series coil and a resistor, the series coil being connected in series with a conducting section that electrically connects the secondary coil to the spark plug, the resistor having a fixed electric resistance value and being connected to the conducting section in parallel with the series coil, wherein the series coil includes an internal resistive component, a parasitic component, and an inductance component, which are connected in parallel with one another, and the fixed electric resistance value of the resistor is smaller than a resistance value of the internal resistive component.

* * * * *